US005377169A

United States Patent [19]

Reeger et al.

[11] Patent Number: 5,377,169

[45] Date of Patent: Dec. 27, 1994

[54] ELECTRONIC EVENT DISPLAY APPARATUS

[76] Inventors: David R. Reeger; Patricia J. Reeger, both of 25444 Shiloh Cir., Conifer, Colo. 80433

[21] Appl. No.: 199,011

[22] Filed: Feb. 18, 1994

[51] Int. Cl.[5] ..... G04F 7/00

[52] U.S. Cl. ..... 368/107; 368/110; 368/111; 368/113; 368/327; 368/89

[58] Field of Search ..... 368/9, 89, 107-113, 368/223, 327

[56] References Cited

U.S. PATENT DOCUMENTS

| | | |
|---|---|---|
| 3,596,103 | 7/1971 | Matthews et al. . |
| 4,671,688 | 6/1987 | Narita et al.Stano et al. ..... 368/9 |
| 4,797,864 | 1/1989 | Stano et al. . |
| 4,941,136 | 7/1990 | Breitung, II . |
| 4,991,156 | 2/1991 | Suga . |
| 5,124,960 | 6/1992 | Miller et al. . |

*Primary Examiner*—Bernard Roskoski

[57] ABSTRACT

A display unit is arranged in cooperation with a twenty-four hour clock to effect registration and storage of timed events and permitting recall of the timed events, with the unit arranged for ease of mounting within an emergency vehicle and the like.

3 Claims, 3 Drawing Sheets

ELECTRONIC EVENT DISPLAY APPARATUS

BACKGROUND OF THE INVENTION

1. Field of the Invention

The field of invention relates to information storage apparatus, and more particularly pertains to a new electronic event display apparatus wherein the same is arranged to store and subsequently display events within a microprocessor memory storage arrangement.

2. Description of the Prior Art

In the use of emergency vehicles, reports require the information as to the time relative to various events in an emergency vehicle response call, such as: when that emergency vehicle leaves a station to when the vehicle arrives at the scene of an emergency; when the emergency vehicle departs the emergency scene for a return trip to when the emergency vehicle actually arrives at the destination or station facility; and when the vehicle is cleared for availability to provide service again. Prior art structure has heretofore not provided the application of contemporary microprocessor units to the specialized events as noted above.

An example of prior art electronic timing measurement and record display means is indicated in U.S. Pat. No. 4,991,156 incorporated herein by reference relative to the storage and retrieval of information.

A further example of prior art electronic timing measurement and record display means is indicated in U.S. Pat. No. 4,797,864 and is also incorporated herein by reference relative to the storage and retrieval of information.

SUMMARY OF THE INVENTION

In view of the disadvantages inherent in the known types of information recall apparatus now present in the prior art, the present invention provides an electronic event display apparatus wherein the same is directed to the recall and subsequent storage of a sequence of timed events. As such, the general purpose of the present invention, which will be described subsequently in greater detail, is to provide a new electronic event display apparatus and method which has many of the advantages of the prior art listed heretofore and many novel features that result in a electronic event display apparatus which is not anticipated, rendered obvious, suggested, or even implied by any of the prior art, either alone or in any combination thereof.

To attain this, the present invention provides a display unit is arranged in cooperation with a twenty-four hour clock to effect registration and storage of timed events and permitting recall of the timed events, with the unit arranged for ease of mounting within an emergency vehicle and the like.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electronic event display apparatus and method which has many of the advantages of the prior art listed heretofore and many novel features that result in a electronic event display apparatus which is not anticipated, rendered obvious, suggested, or even implied by any of the prior art, either alone or in any combination thereof.

It is another object of the present invention to provide a new electronic event display apparatus which may be easily and efficiently manufactured and marketed.

It is a further object of the present invention to provide a new electronic event display apparatus which is of a durable and reliable construction.

An even further object of the present invention is to provide a new electronic event display apparatus which is susceptible of a low cost of manufacture with regard to both materials and labor, and which accordingly is then susceptible of low prices of sale to the consuming public, thereby making such electronic event display apparatus economically available to the buying public.

Still yet another object of the present invention is to provide a new electronic event display apparatus which provides in the apparatuses and methods of the prior art some of the advantages thereof, while simultaneously overcoming some of the disadvantages normally associated therewith.

Yet an even further object of the present invention is to provide a new electronic event display apparatus display unit arranged in cooperation with a twenty-four hour clock to effect registration and storage of timed events and permitting recall of the timed events, with the unit arranged for ease of mounting within an emergency vehicle and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
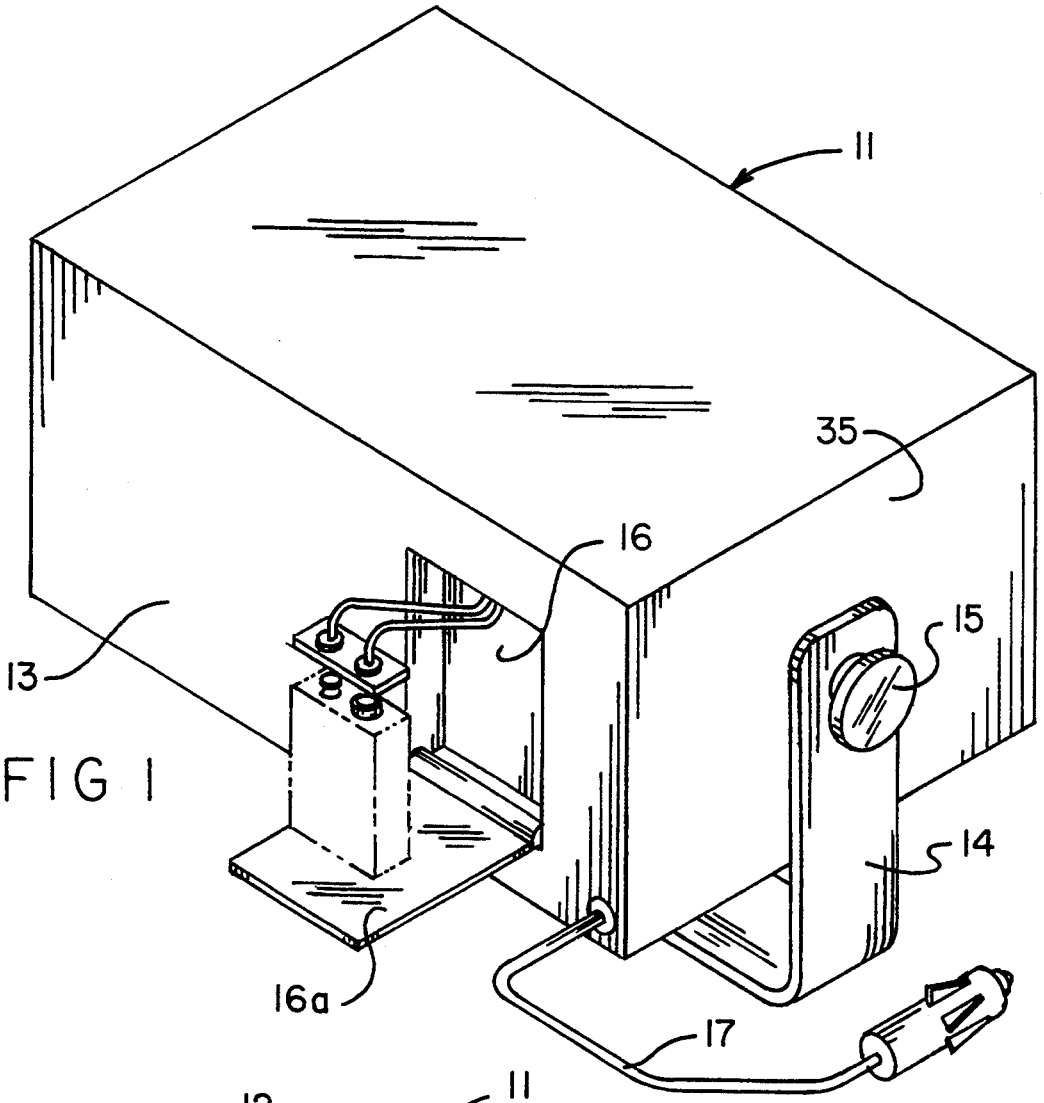
FIG. 1 is an isometric illustration of the display housing of the invention.
Figure 2:
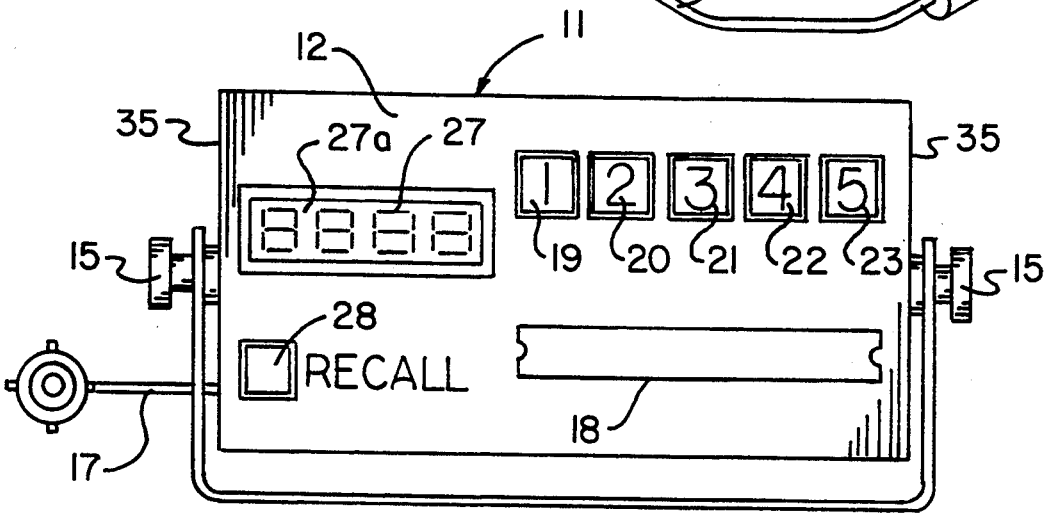
FIG. 2 is an orthographic frontal view, taken in elevation, of the housing as indicated in FIG. 1.

With reference now to the drawings, and in particular to FIGS. 1 to 7 thereof, a new electronic event display apparatus embodying the principles and concepts of the present invention and generally designated by the reference numeral 10 will be described.

More specifically, the apparatus 10 of the instant invention comprises a display housing 11 having a front wall 12 spaced from a rear wall 13, with spaced housing side walls 35, such that a U-shaped support bracket 14 may extend along the side walls to receive a bracket fastener 15 securing the support bracket to the side walls of the housing structure. A battery compartment 16 is directed into the rear wall 13 of the housing to provide for an auxiliary power supply relative to the twelve volt power supply cable 17 and adapter, as illustrated in FIG. 1.

Figure 3:
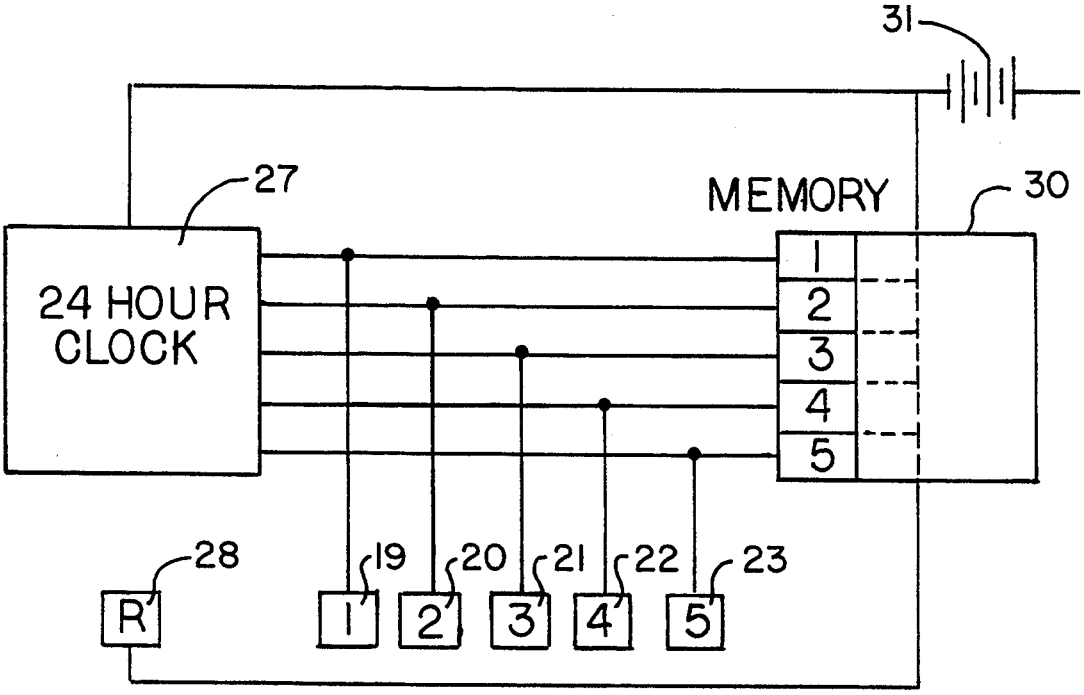
FIG. 3 is a diagrammatic illustration of the cooperation of the recall buttons in association with a microprocessor and memory storage unit.
Figure 5:
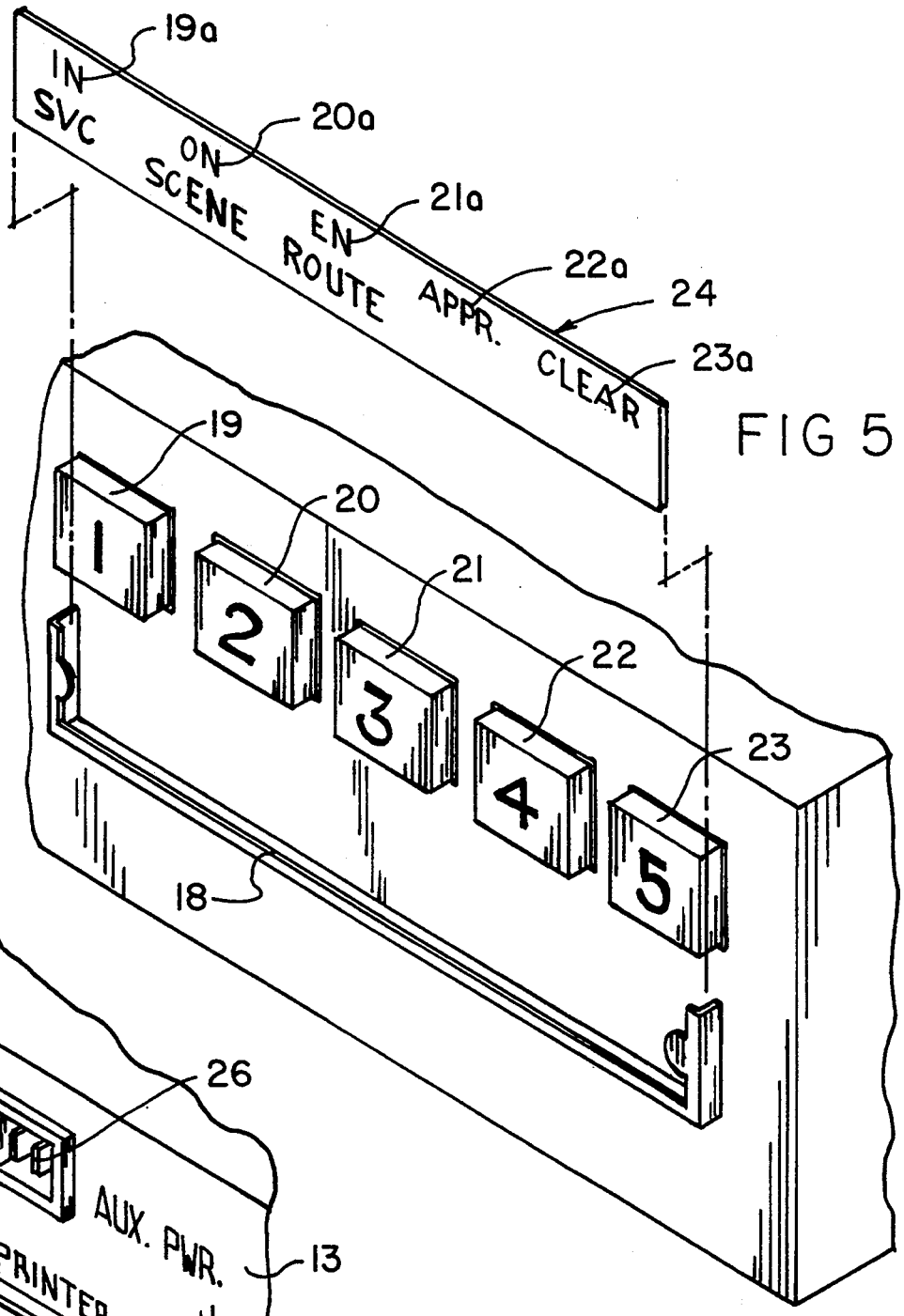
FIG. 5 is an enlarged isometric illustration of the front face of the display housing.

Referring now to FIGS. 3 and 5, it can be shown that the front wall 12 includes a U-shaped card support 18 arranged to receive an indicator plate 24. The indicator plate 24 is positioned below a horizontal array of event buttons defined by respective first, second, third, fourth, and fifth event buttons 19, 20, 21, 22, and 23. A twenty-four hour clock 27 is arranged that such that upon depressing the buttons 1–5, the time displayed on the clock 27 is registered within a microprocessor memory 30 and associated to a respective first through fifth event button 19–23. The clock window **27*a* is operable as a display window upon the replay and display of the events from the microprocessor 30. If required, fewer or more of such event buttons may be employed, as indicated in FIG. 3, to direct a time for storage into the microprocessor 30. The organization is powered typically by a power supply 31, such as a vehicle battery, to direct electrical current through the power supply cable 17**.

To use the device 10 to store an event, a user merely depresses an event button upon the initiation of the recorded event, such as the first through fifth event buttons 19–23 in sequence, whereby such times are recorded in memory of the microprocessor 30. To recall the event time for subsequent recordation thereof, a recall button 28 is pressed a number of times equal to the digital enumeration of the buttons indicated as the first through fifth event buttons 19–23. Typically, in an emergency vehicle, the five events to be timed in the events one through five relative to the first through fifth buttons are: 1) time the emergency vehicle leaves the station in response to an event; 2) when the emergency vehicle arrives at the scene of the event; 3) when the emergency vehicle departs from the event for a return trip to the station; 4) when the emergency vehicle arrives at the station; and 5) when the emergency vehicle is cleared for service once again.

Figure 4:
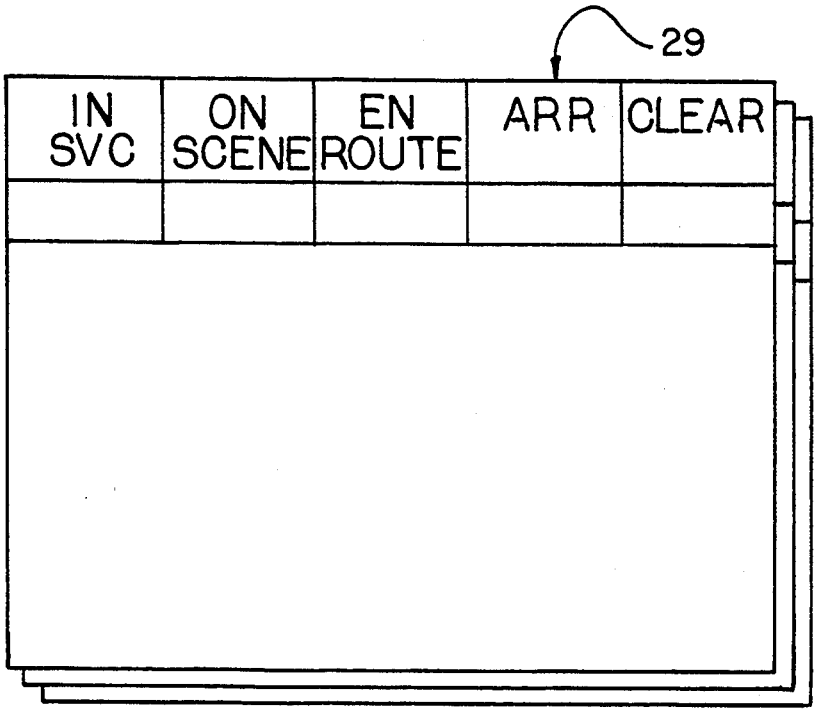
FIG. 4 is an orthographic top view of indication forms arranged to permit an emergency vehicle operator to direct and impart information upon the form derived from the recall of events in the display window of the organization.

Upon recall of the events, such information is typically directed onto a ledger in the form of an indication form 29, as indicated in FIG. 4. Further, as indicated in FIG. 5, the indicator plate 24 is provided with one through five event indicia positioned in adjacency to the first through fifth event buttons, with the indicia indicated as the first through fifth indicia **19*a*, 20*a*, 21*a*, 22*a*, and 23*a*** respectively.

Figure 6:
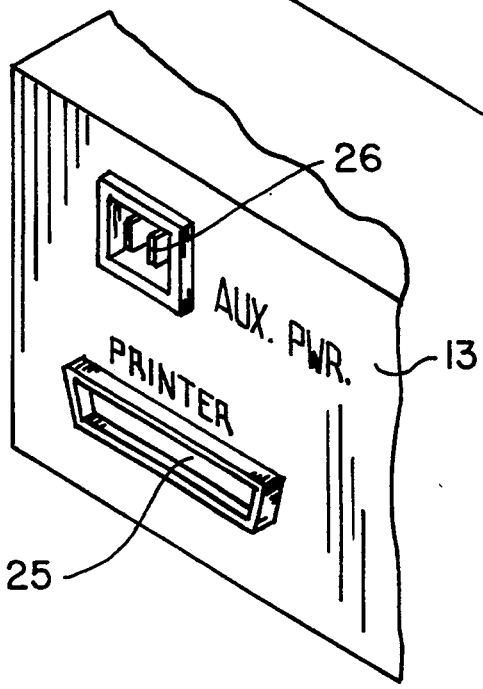
FIG. 6 is an isometric illustration of the rear wall display housing to indicate the use of a printer port.

The FIG. 6 indicates that a printer port 25 is directed into the housing rear wall 13, as well as an auxiliary power supply connector if required.

The U.S. Pat. No. 4,991,156 indicates a typical microprocessor arrangement utilized to provide for the storage and recall of timed events.

As to the manner of usage and operation of the instant invention, the same should be apparent from the above disclosure, and accordingly no further discussion relating to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electronic event display apparatus comprising:

a display housing having a front wall spaced from a rear wall and a display housing side wall;

a plurality of event buttons arranged upon the front wall of the housing;

a U-shaped card support member positioned below the event buttons on the front wall;

a twenty-four hour indicator clock having a display window directed through the front wall of the housing for viewing thereof;

microprocessor means for storing clock times indicated by the clock and directed into the microprocessor in accordance with a depression of the event buttons;

and, a recall button means for recalling the clock times in accordance with a number of times the recall button is depressed and displaying the according clock time upon the display window.

2. An apparatus as set forth in claim 1, wherein the U-shaped card support member includes an indicator plate slidably received within the U-shaped card support member, with the indicator plate having a plurality of event indicia printed thereon, with an individual one of the event indicia positioned below an individual one of the buttons.

3. A method of recording timed events of an emergency vehicle within an device having an electronic clock, a plurality of buttons, each of said buttons being operable to store a clock time within a microprocessor memory, and a recall button for recalling the stored clock times for display upon a display window, said method comprising the steps of:

a) depressing a first button in accordance with a time that the emergency vehicle leaves a station in response to an event;

b) depressing a second button in accordance with a time when the emergency vehicle arrives at a scene of the event;

c) depressing a third button in accordance with a time when the emergency vehicle departs from the event for a return trip to the station;

d) depressing a fourth button in accordance with a time when the emergency vehicle arrives at the station;

e) depressing a fifth button in accordance with a time when the emergency vehicle is cleared for service from the station;

f) depressing the recall button a number of times equal to the digital enumeration of the buttons indicated as the first through fifth buttons to display the stored times upon the display window; and, g) recording the recalled times upon an indication form.

* * * * *